US007757507B2

(12) United States Patent
Kim et al.

(10) Patent No.: US 7,757,507 B2
(45) Date of Patent: Jul. 20, 2010

(54) AIR CONDITIONER

(75) Inventors: Seok Hun Kim, Busan (KR); Dong Joo Han, Changwon-si (KR); Youg Won Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1005 days.

(21) Appl. No.: 11/150,243

(22) Filed: Jun. 13, 2005

(65) Prior Publication Data

US 2005/0274135 A1 Dec. 15, 2005

(30) Foreign Application Priority Data

Jun. 14, 2004 (KR) ..... 10-2004-0043636
Jun. 15, 2004 (KR) ..... 10-2004-0044111
Aug. 19, 2004 (KR) ..... 10-2004-0065507

(51) Int. Cl.
*F25B 23/12* (2006.01)

(52) U.S. Cl. ..... 62/262; 62/408

(58) Field of Classification Search ..... 62/262, 62/263, 259.4, 419, 408
See application file for complete search history.

(56) References Cited

U.S. PATENT DOCUMENTS 2,952,995 A * 9/1960 Brannick ..... 62/295
3,274,919 A * 9/1966 Wegman ..... 454/316
3,296,820 A * 1/1967 Bauman ..... 62/262
5,904,048 A * 5/1999 Lee ..... 62/131
6,223,547 B1 * 5/2001 da Silva et al. ..... 62/262
6,276,156 B1 * 8/2001 da Silva et al. ..... 62/262
6,279,339 B1 * 8/2001 Correa et al. ..... 62/262
6,301,914 B1 * 10/2001 Oliva et al. ..... 62/262
6,318,104 B1 * 11/2001 Moraes et al. ..... 62/262
6,330,807 B1 * 12/2001 Correa et al. ..... 62/262
2002/0056282 A1 * 5/2002 An ..... 62/262
2005/0039480 A1 * 2/2005 Kim ..... 62/262
2005/0056038 A1 * 3/2005 Park et al. ..... 62/262

* cited by examiner

*Primary Examiner*—Melvin Jones
(74) *Attorney, Agent, or Firm*—Birch, Stewart, Kolasch & Birch, LLP

(57) ABSTRACT

Air conditioner including a cabinet having room air inlets in at least one of side surfaces and a top surface, and a room air outlet in a front surface, and a front panel in front of the cabinet, thereby cooling/heating a room quickly, and improving thermal efficiency by preventing discharged air from re-entering into the air conditioner, directly.

19 Claims, 14 Drawing Sheets

AIR CONDITIONER

CROSS-REFERENCE TO RELATED APPLICATIONS

This application claims the benefit of Korean Application Nos. P2004-043636 filed on Jun. 14, 2004, P2004-044111 filed on Jun. 15, 2004, and P2004-065507 filed on Aug. 19, 2004, which are hereby incorporated by reference as if fully set forth herein.

BACKGROUND OF THE INVENTION

1. Field of the Invention

The present invention relates to air conditioners, and more particularly, to an air conditioner, in which a structure of a cabinet is improved for room air circulation, and free direction change of air flow from the cabinet.

2. Discussion of the Related Art

The air conditioner cools or heats a room, or cleans air for forming more comfortable room environment. The air conditioner is provided with a refrigerating system having a compressor, a condenser, an expansion valve, an evaporator, and, in the air conditioners, there are split type and package type.

The split type air conditioner has a cooling/heat dissipation device mounted on an indoor unit, and heat dissipation/cooling device and a compression device mounted on an outdoor unit, with refrigerant pipes connected between the indoor unit and the outdoor unit separated thus. Even though having the same functions with the split type air conditioner, the package type air conditioner has the indoor unit and the outdoor unit packaged in one unit, for installation on a wall or window of a house.

FIG. 1 illustrates a perspective view of a related art package type air conditioner, and FIG. 2 illustrates an exploded perspective view of a related art package type air conditioner, and FIG. 3 illustrates a longitudinal section of a related art package type air conditioner.

Referring to FIGS. 1 to 3, the related art package type air conditioner is provided with a base 2, a cabinet 4 on the base 2, and an air guide 6 for dividing a cabinet space into an indoor side space 'I' and an outdoor side space 'O'.

On a front of the cabinet 4, there is a front panel 9 of the package air conditioner. Inside of the cabinet, there are a compressor 12 for converting the refrigerant from a low temperature, low pressure gas to a high temperature, high pressure gas, and a condenser 14 for condensing the refrigerant from the compressor 12 into a liquid state refrigerant.

Inside of the cabinet, there are also an expansion valve (not shown) for expanding the high temperature, high pressure refrigerant condensed at the condenser 14 into a two phased (a mixture of liquid and gas) low temperature, low pressure refrigerant, and an evaporator 16 for evaporating the two phased refrigerant from the expansion valve into a gas state.

In the meantime, there are outdoor inlets 5 in side and top surfaces of the cabinet which form the outdoor space 'O' for drawing outdoor air, and a back side of the cabinet is opened for discharging the air to the outdoor.

The air guide 6 has a lower guide 7 on the base 2, and an upper guide 8 over the lower guide 32.

The front panel 9 has a room air inlet 10 in a front surface for drawing room air, and a room air outlet passage 11 over the room air inlet 10. The room air inlet 10 has a suction grill 10*a* mounted thereon, and the room air outlet passage 11 has a plurality of air direction control louvers 11*a*.

The plurality of air direction control louvers 11*a* are left/right direction air direction control louvers for controlling an air direction in left/right directions, and up/down air direction control louvers for controlling an air direction in up/down directions.

The package type air conditioner has a bilateral motor 20 fixedly secured to the air guide 6 between the indoor side space 'I', and the outdoor side space 'O'. The bilateral motor 20 has a front shaft 20*a* projected to the indoor side space, and a rear shaft 20*b* projected to the outdoor side space.

The front shaft 20*a* has a turbofan 24 coupled thereto for forced circulation of room air through the evaporator 16, and on a suction side of the turbofan 24, there is an orifice 26 for making a speed of the air faster.

The rear shaft 20*b* has a propeller fan 28 for forced pass of outdoor air through the condenser, and in rear of the propeller fan 26, there is a shroud for forming a flow path of the room air drawn by the propeller fan 26.

The operation of the related art package type air conditioner will be described.

Upon putting the package type air conditioner into operation, the refrigerant circulates through the refrigerating cycle having the compressor 12, the condenser 14, the expansion device (not shown), the evaporator 16, and the bilateral motor 20 rotates the turbofan 24 and the propeller fan 28.

Then, air in front of the package type air conditioner is drawn backward by the turbofan 24, and passes through the air inlet 10 in the front panel 9. The room air is cooled down at the evaporator 16, and passes through the orifice 26, the lower guide 7, and the upper guide 8 in succession. Then, the room air passes through the air outlet passage 11 in the front panel 9, and is discharged to a front side of the package type air conditioner, again.

In the meantime, outdoor air is drawn through the inlets 5 in the cabinet 4 by the propeller 28, passes through the shroud 30, and takes heat from the refrigerant at the condenser 14, and is discharged to an outside of the room.

However, the related art air conditioner has the following problems.

First, in order to discharge heat exchanged air, the left/right air direction control louvers or the up/down air direction control louvers are required, without fail. However, small and plural louvers in the cabinet make an inside of the air conditioner dirty as foreign matters stick to the louvers, and cause difficulty in removal of the foreign matters. Moreover, the mounting of the plurality of the louvers is difficult and increases cost.

Second, if only one of the plurality of the left/right air direction control louvers or the plurality of up/down air direction control louvers is mounted, a range of air direction control is limited as the room air direction can be controlled in one of the left/right or up/down direction.

Third, the concentration of discharge of the air into the room only on an upper forward part of the package type air conditioner required a substantial time period in spreading in the room.

Fourth, the room air inlet, and the room air outlet in the same front surface of the package type air conditioner causes a problem in that a substantial amount of discharged air is drawn again, directly.

SUMMARY OF THE INVENTION

Accordingly, the present invention is directed to an air conditioner that substantially obviates one or more problems due to limitations and disadvantages of the related art.

An object of the present invention is to provide an air conditioner which can control a direction of air, selectively.

Another object of the present invention is to provide an air conditioner which enables easy removal of foreign matters from air outlets.

Another object of the present invention is to provide an air conditioner which enables fast spreading of conditioned air into a room.

A further object of the present invention is to provide an air conditioner which can minimize a reverse flow of discharged air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the air conditioner includes a cabinet having room air inlets in at least one of side surfaces and a top surface, and a room air outlet in a front surface, and a front panel in front of the cabinet.

Preferably, the front panel is mounted spaced from a predetermined distance from the front surface of the cabinet for discharging air between the front panel and the front surface of the cabinet.

Preferably, the front panel includes a panel mounting portion for mounting the front panel to the cabinet.

In more detail, preferably, the front panel is fixed with respect to the cabinet. Of course, the front panel may move parallel to the cabinet.

In another aspect of the present invention, an air conditioner includes a cabinet having room air inlets in at least one of side surfaces and a top surface, and a room air outlet in a front surface, and a front panel in front of the room air outlet, for adjusting an air flow direction of room air discharged from the room air outlet by moving relative to the cabinet.

Preferably, the front panel is tilted freely at least one direction with respect to the cabinet.

Preferably, the air conditioner further includes a panel supporter for supporting the front panel.

In more detail, preferably, the panel supporter includes a mounting bar fixedly secured to the front panel, a ball connected to the mounting bar, and a ball socket for holding the ball.

Preferably, the panel supporter further includes a supporting member for connecting the ball socket to the cabinet.

Preferably, the ball socket has a spherical hole having one opened side, and mounted at a center of the air outlet.

In the meantime, the front panel may move in a front/rear direction of the room air outlet.

Preferably, the air conditioner further includes a panel supporter for supporting, and guiding a moving direction of the front panel.

Preferably, the panel supporter includes a mounting bar fixedly secured to the front panel, a boss having the mounting bar passed therethrough, and at least one arm between the boss and the front panel.

In more detail, the mounting bar moves in front/rear direction of the room air outlet, together with the front panel.

One of the mounting bar or the boss may have a male thread formed thereon, and the other one has a female thread formed thereon.

The air conditioner may further include a panel mover for moving the front panel.

Preferably, the panel mover includes a piston in rear of the front panel, and a motor for driving the piston.

The panel mover may include a motor for driving the front panel, and a power transmission device for transmission of power from the motor to the front panel.

In more detail, the power transmission device includes a first gear fixedly secured to a rotation shaft of the motor, and a second gear engaged with the first gear.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
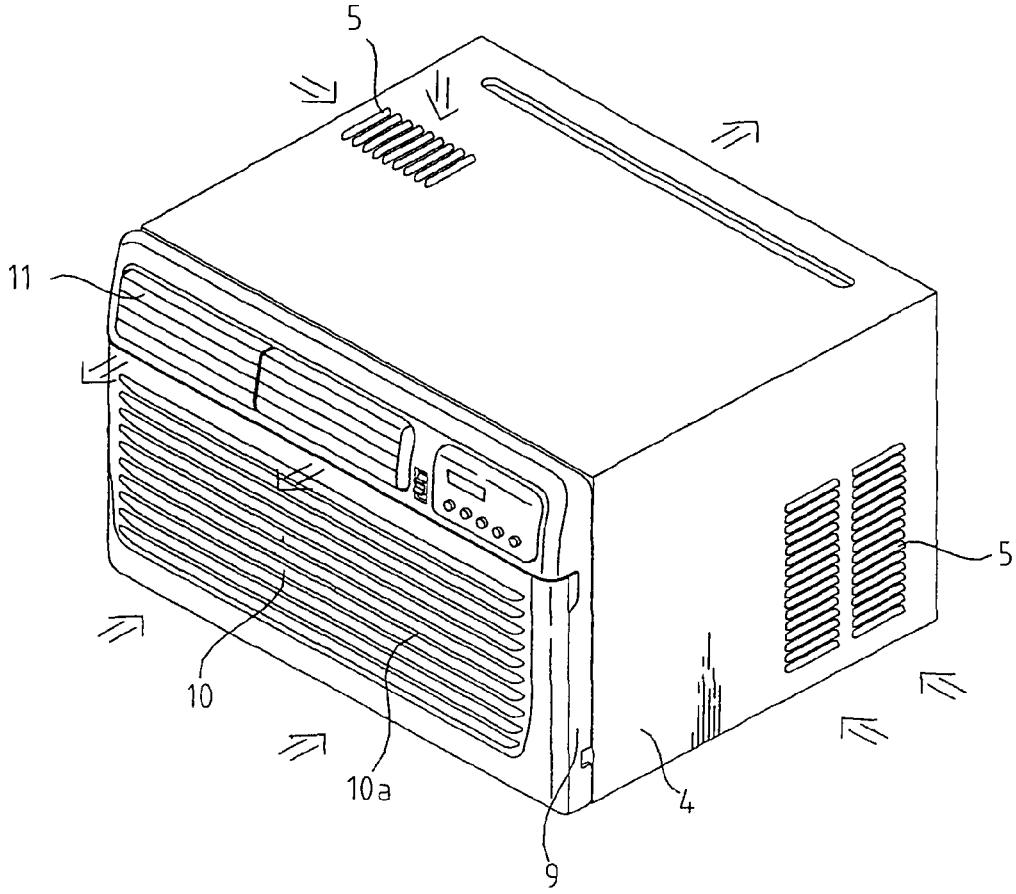
FIG. 1 (Related Art)
FIG. 1 illustrates a perspective view of a related art package type air conditioner.
Figure 2:
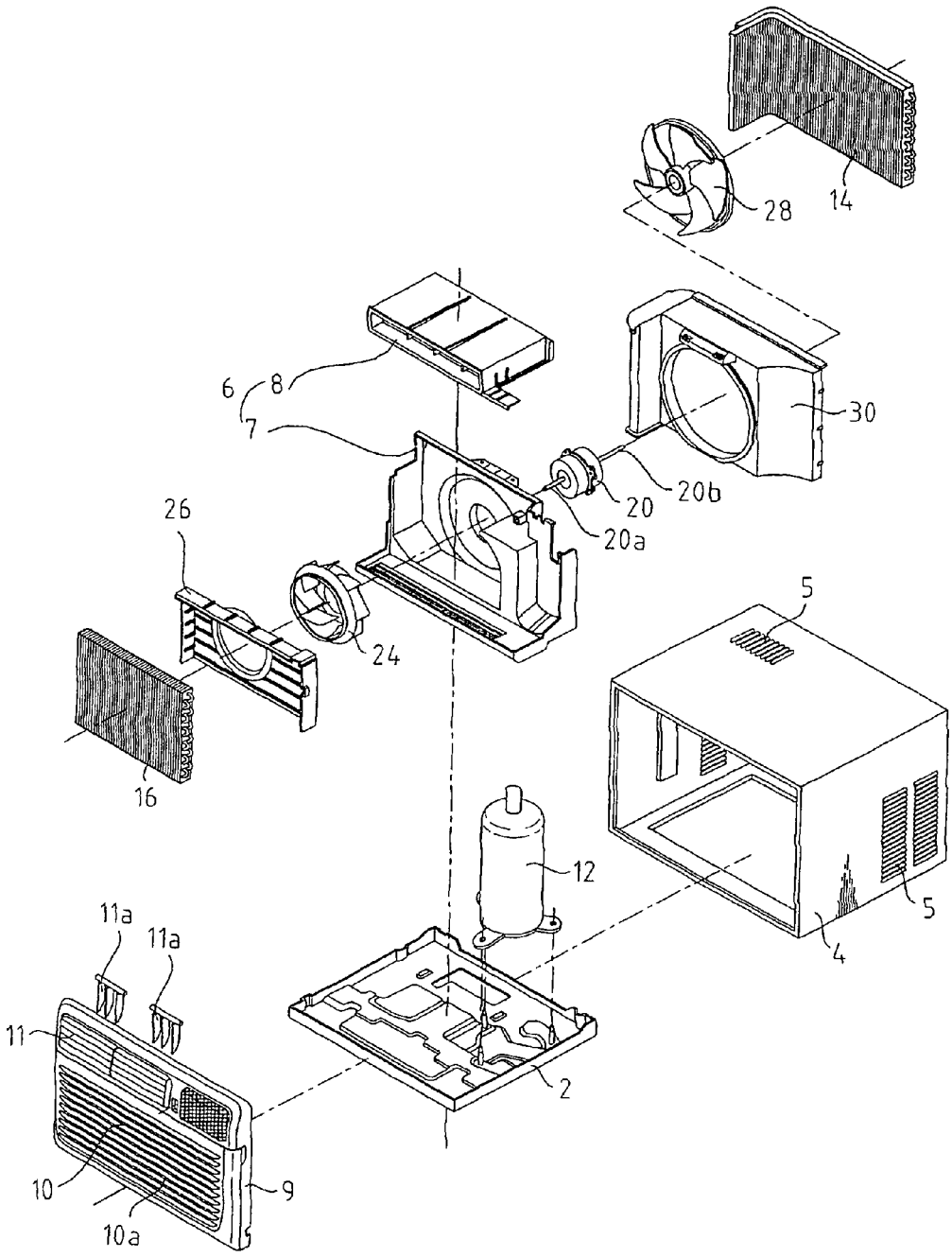
FIG. 2 (Related Art)
FIG. 2 illustrates an exploded perspective view of a related art package type air conditioner.
Figure 3:
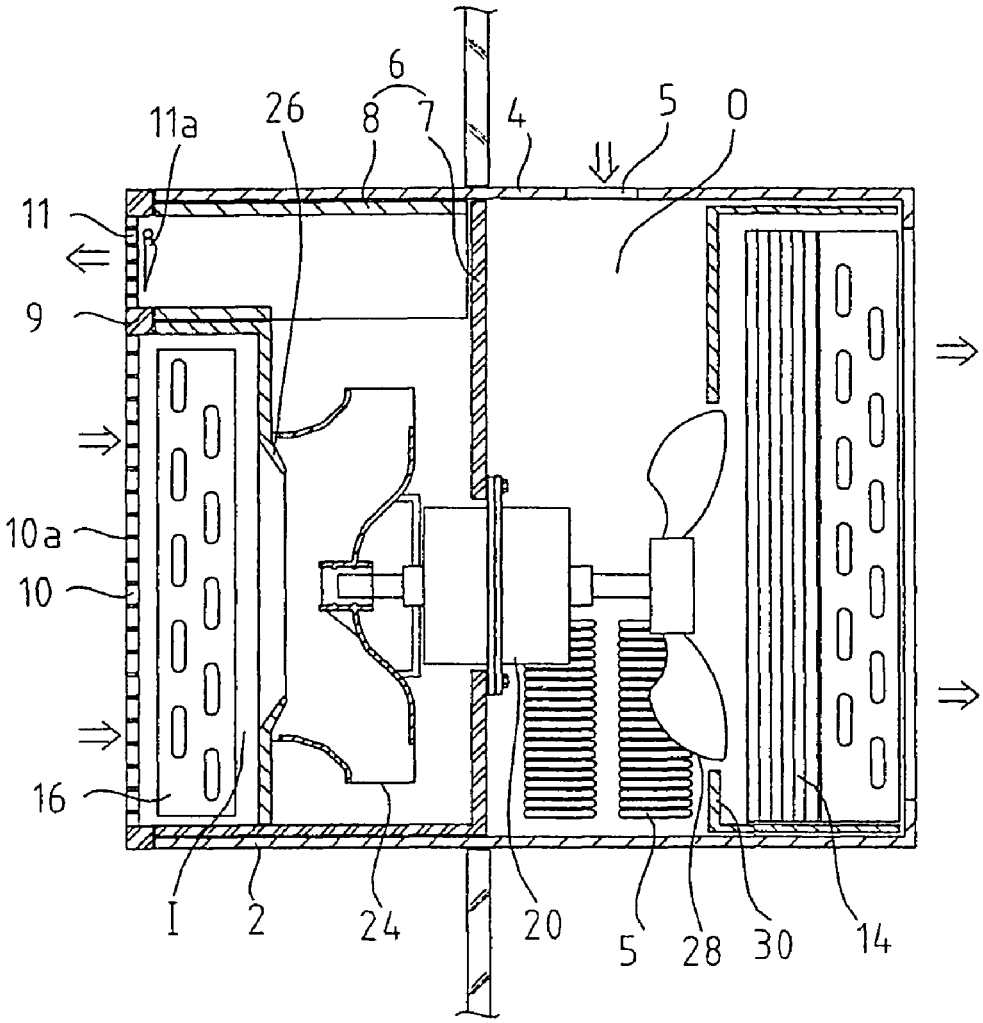
FIG. 3 (Related Art)
FIG. 3 illustrates a longitudinal section of a related art package type air conditioner.
Figure 4:
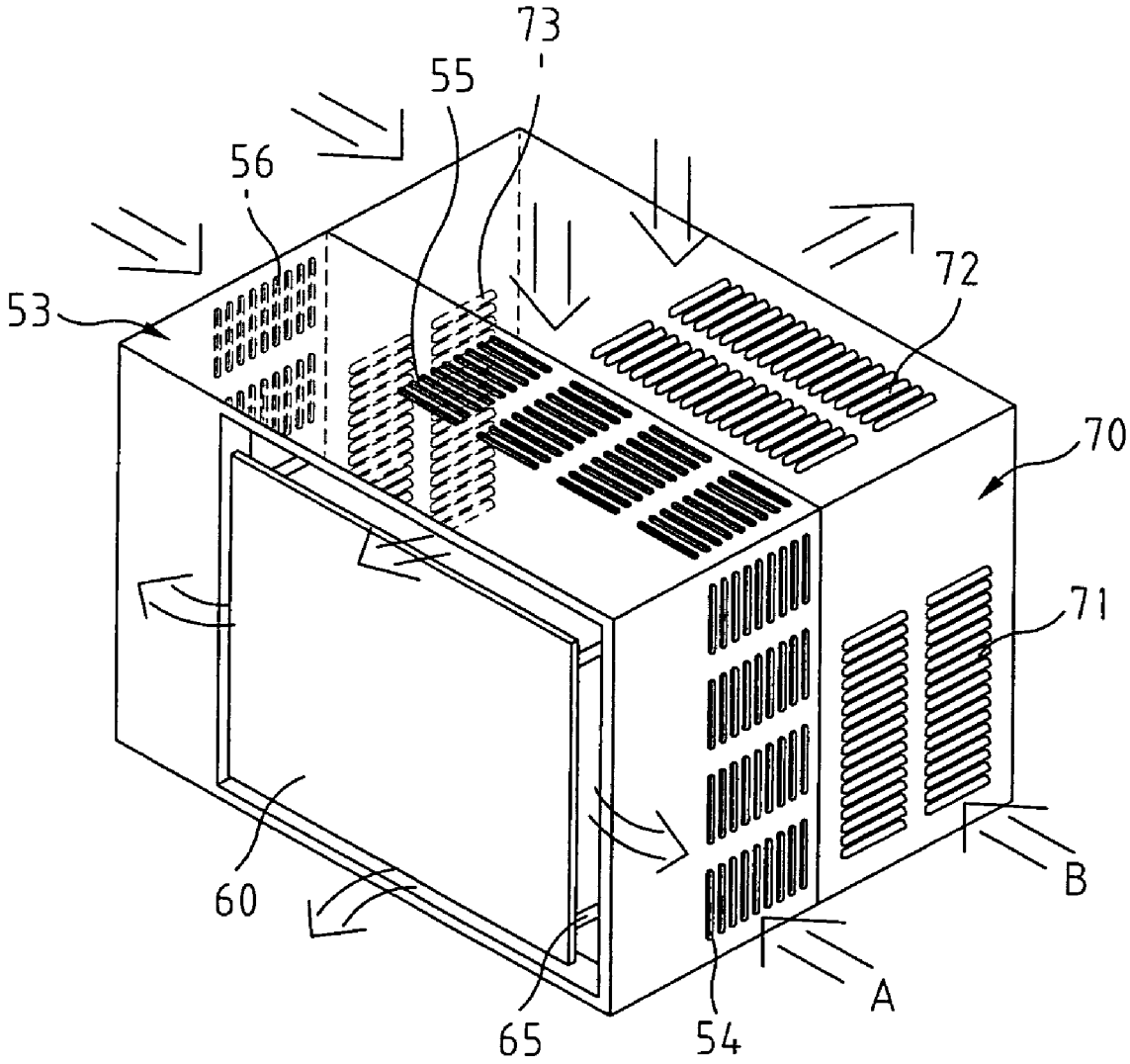
FIG. 4 illustrates a perspective view of an air conditioner in accordance with a first preferred embodiment of the present invention.
Figure 5:
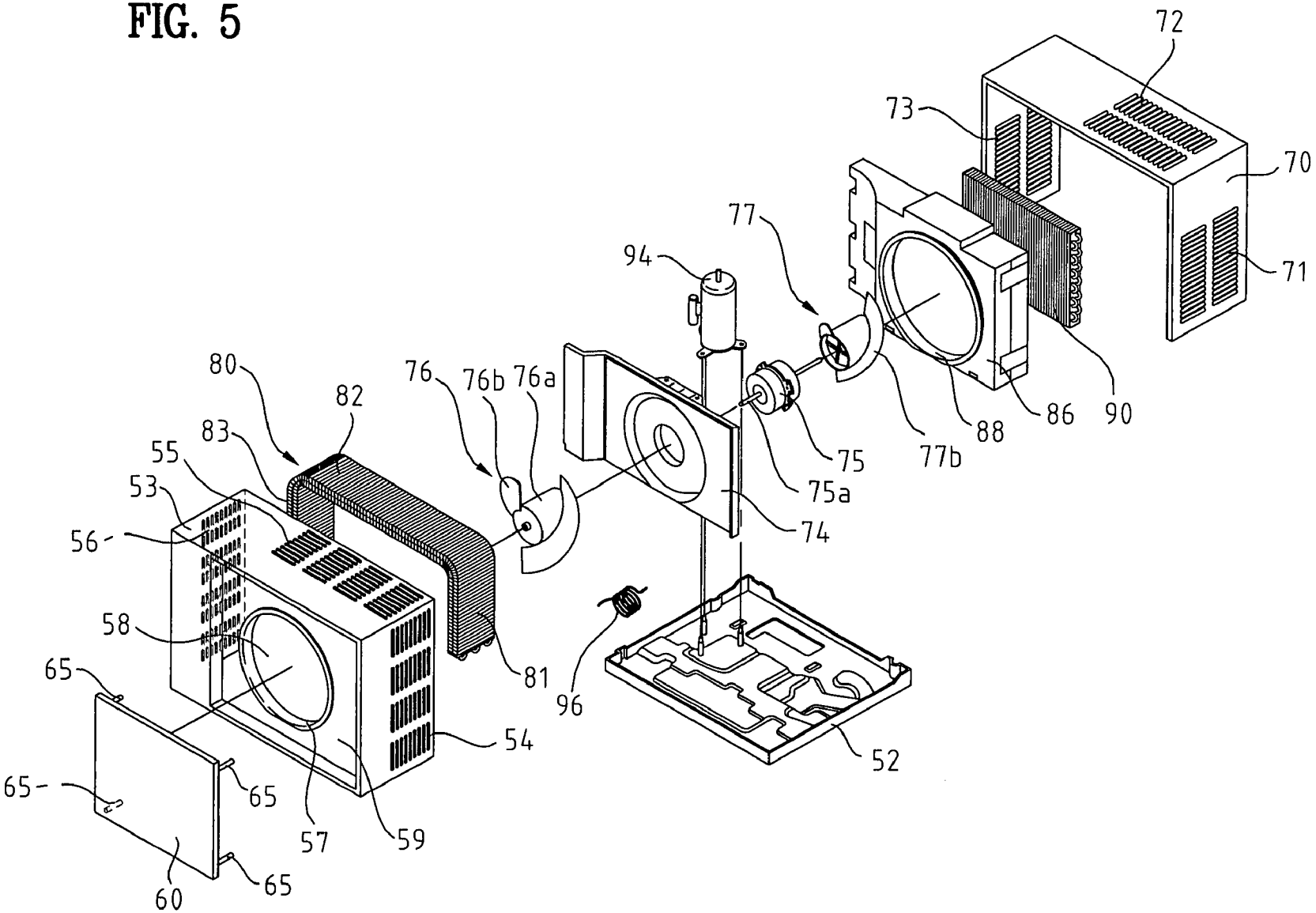
FIG. 5 illustrates an exploded perspective view of the air conditioner in FIG. 4.
Figure 6:
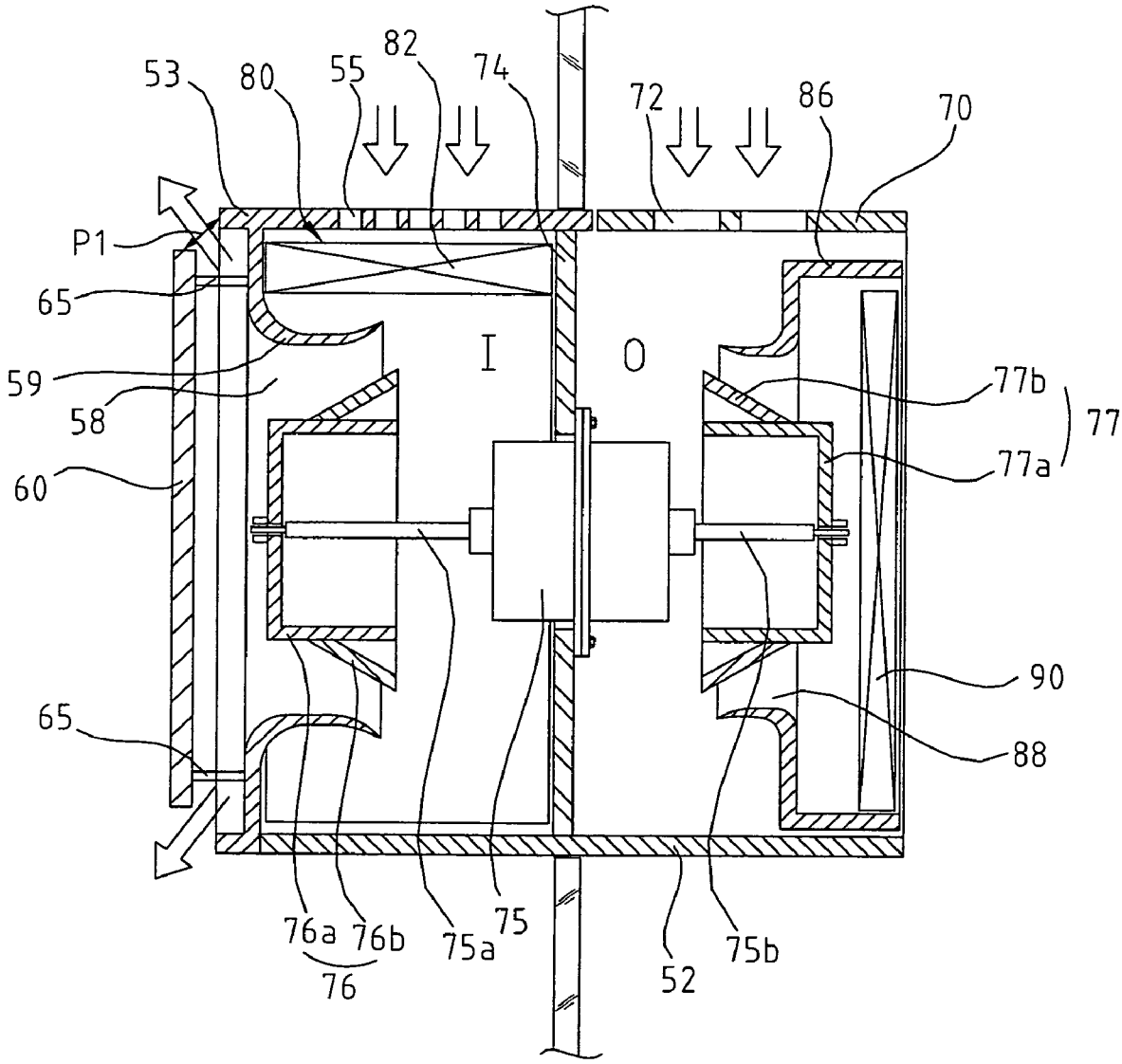
FIG. 6 illustrates a longitudinal section of the air conditioner in FIG. 4.

FIG. 4 illustrates a perspective view of an air conditioner in accordance with a first preferred embodiment of the present invention, FIG. 5 illustrates an exploded perspective view of the air conditioner in FIG. 4, and FIG. 6 illustrates a longitudinal section of the air conditioner in FIG. 4.

Referring to FIGS. 4 to 6, the air conditioner in accordance with a first preferred embodiment of the present invention will be described.

The air conditioner includes a cabinet having room air inlets formed in at least one of side surfaces, or a top surface, and a front panel on a front of the cabinet.

The cabinet includes a front cabinet 53 having an indoor heat exchanger 80 mounted therein for heat exchange with room air introduced thereto, and a rear cabinet having an outdoor heat exchanger 90 mounted therein in correspondence to the indoor heat exchanger 80.

The front cabinet 53 and the rear cabinet 70 are mounted on one base 52, and the front cabinet 53 and the rear cabinet 70 are separated by a barrier 74.

However, the present invention is not limited to above, but the front cabinet and the rear cabinet may be mounted on individual bases separate from each other. That is, the present invention is applicable, not only to the package type air conditioner, but also to the split type air conditioner.

In a front surface of the front cabinet 53, there is a room air outlet 58 for making the air heat exchanged at the indoor heat exchanger 80 to be discharged to a predetermined direction in front of the front cabinet. Moreover, at least one of side surfaces or a top surface of the front cabinet 53, there is room air inlet 54, 55, and 56 for drawing room air.

In more detail, in a right side surface of the front cabinet, there is a right side air inlet 54, in a top surface of the front cabinet, there is a top side air inlet 55, and in a left side surface of the front cabinet, there is a left side air inlet 56.

Therefore, referring to FIG. 4, the room air 'A' is drawn through the side surfaces and the top surface, and discharged to front of the front cabinet 53.

However, the present invention is not limited to the embodiment described above, the air inlets 54, 56 may be formed only in the left, and right surfaces of the front cabinet 53, without the top side air inlet. In this case, a structure of the front cabinet can be simplified, and infiltration of water or foreign matters through the top side air inlet can be prevented.

In front of the front cabinet 53, there is a front panel 60 mounted spaced a predetermined distance from the front cabinet 53 for controlling a direction of the room air.

In more detail, there is a room air outlet 58 in a front surface of the front cabinet 53 for discharging the air while the air is being spread, and the front panel 60 is in front of the room air outlet 58.

The front panel 60 has a size slightly smaller the room air outlet 58, and secured to the front cabinet 53. The front panel 60 may have a shape varied with a shape of the room air outlet 58.

For an example, if the room air outlet is circular, a disk shape of front panel may be used, and if the room air outlet is square, a square front panel may be used. Of course, the front panel may have a shape irrelevant to the shape of the room air outlet.

In the meantime, the front panel 60 has a panel mounting part 65 for mounting the front panel 60 to the front cabinet 53. The panel mounting part 65 includes mounting projections each projected from a back surface of the front panel. The mounting projections are attached to the front cabinet 53 with adhesive or the like.

However, the present invention is not limited to above embodiment, but the mounting projections may be formed on the front cabinet. The panel mounting part may include the mounting projections on one of the front panel and the front cabinet, and mounting holes in the other one of the front panel and the front cabinet. Moreover, the panel mounting part may have a pivot for movement of the front panel in parallel to the front cabinet.

In the meantime, the base 52 has a barrier 74 standing at middle for dividing the inside of the air conditioner into an indoor side space 'I' and an outdoor side space 'O'. The barrier 74 has a bilateral motor 75 at a center for circulating air. The bilateral motor 75 has a front rotation shaft 75*a* projected forward and a rear rotation shaft 75*b* projected backward.

Secured to the front rotation shaft 75*a* of the bilateral motor 75 is a room fan 76 for circulating room air. Secured to the rear rotation shaft 75*b* is an outdoor fan 77 for circulating outdoor air. In more detail, the room fan 76 in the front cabinet 53 draws air through the room air inlets 54, 55, and 56, and blows toward the room air outlet 58. The outdoor fan 77 in the rear cabinet 70 draws air through the outdoor air inlets 71, 72, and 73, and discharges through a back surface of the rear cabinet 70.

The room fan 76 includes a hub 76*a* fixedly secured to the front rotation shaft 75*a*, and a plurality of blades 76*b* each extended in a helix on an outside circumference of the hub 76*a*. The outdoor fan 77 includes a hub 77*a* fixedly secured to the rear rotation shaft 75*b*, and a plurality of blades 77*b* each extended in a helix on an outside circumference of the hub 77*a*. In the present invention, above shaped fan is called as "kai-fan" or "x-fan".

There is an indoor heat exchanger 80 between the front cabinet 53 and the room fan 76, for making the air drawn by the room fan 76 to be heat exchanged.

The indoor heat exchanger 80 has an inverted 'U' shape for effective cooling/heating of the air drawn through the right side air inlet 54, the top side air inlet 55, and the left side air inlet 56, of the front cabinet 53.

That is, the indoor heat exchanger 80 includes a right side heat exchange portion 81 adjacent to the right side air inlet 55, a top side heat exchange portion 82 under the top side air inlet 55, and a left side heat exchange portion 83 adjacent to the left side air inlet 56.

In the meantime, in the rear cabinet 70, there is a shroud 86 for forming a flow path of the outdoor air drawn by the outdoor fan 77. The shroud 86 has an orifice 88 for controlling an air flow. On an inside, or in rear of the shroud 86, there is an outdoor heat exchanger 90.

The outdoor heat exchanger 90 is hexahedral. Of course, the outdoor heat exchanger 90 may have a shape identical to the indoor heat exchanger 80.

The outdoor heat exchanger 90 cools or heats the air introduced through the air inlets 71, 72, and 73 in the rear cabinet 70. The air inlets 71, 72, and 73 include a right side air inlet 71 in a right side surface, a top side air inlet 72 in a top side surface, and a left side air inlet 73 in a left side surface, of the rear cabinet 70.

In the rear cabinet 70, there is a compressor 94 for converting low temperature, low pressure gaseous refrigerant into high temperature, high pressure gaseous refrigerant. The refrigerant passed through the compressor 94 is expanded at a capillary tube.

The operation of the air conditioner of the present invention will be described.

Upon putting the air conditioner into operation, the compressor 94 converts the refrigerant into high temperature, high pressure gaseous state. The high temperature, high pressure gaseous refrigerant passes through, and condensed at the outdoor heat exchanger 90, and passes through, and is converted into two phased refrigerant at the capillary tube 96.

Then, the refrigerant passes through, and evaporates at the indoor heat exchanger 80, and the compressor 94.

The air conditioner puts the bilateral motor 75 into operation, to rotate the room fan 76 and the outdoor fan 77. A negative pressure is formed in the vicinity, or rear of the room fan 76. The air around the front cabinet 53 passes through the right side air inlet 54, the top side air inlet 55, and the left side air inlet 56, of the front cabinet 53, and is drawn into the indoor side space 'I' of the air conditioner.

The air, drawn through the right side air inlet 54, the top side air inlet 55, and the left side air inlet 56, passes the left side heat exchanger portion 83, the top side heat exchanger portion 82, and the right side heat exchanger portion 81, and heat exchanges with the refridgerant. Then, the heat exchanged air is drawn into the room fan 76, and blown to front of the room fan 76.

The air blown thus passes through the orifice 57, is guided to the room air outlet 58 of the air discharge guide 59, and discharged in upper, lower, left, and right directions of forward of the air conditioner.

In the meantime, when the outdoor fan 77 rotates, a negative pressure is formed around or in front of the outdoor fan 77. The outdoor air in the vicinity of the rear cabinet 70 passes through the right side air inlet 71, the top side air inlet 72, and the left side air inlet 73 of the rear cabinet 70, and is drawn into the outdoor side space 'O' of the air conditioner. The drawn outdoor air is blown to rear of the outdoor fan 77 by the outdoor fan 77.

The outdoor air blown to rear passes through the orifice 88, and heat exchanges with the outdoor heat exchanger 90 as the outdoor air passes through the outdoor heat exchanger 90. The heat exchanged outdoor air is discharged to rear of the air conditioner through a back side of the rear cabinet 70.

Figure 7:
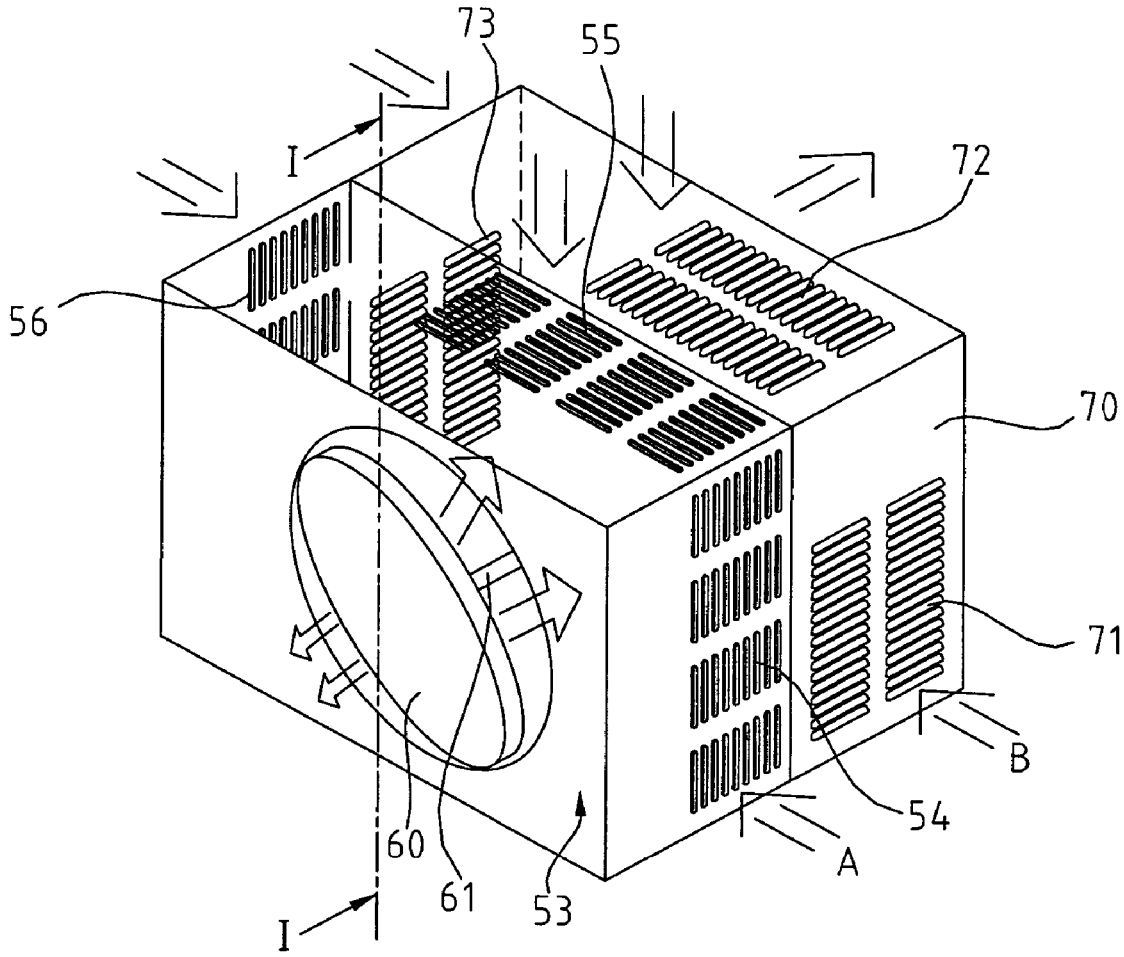
FIG. 7 illustrates a perspective view of an air conditioner in accordance with a second preferred embodiment of the present invention.
Figure 8:
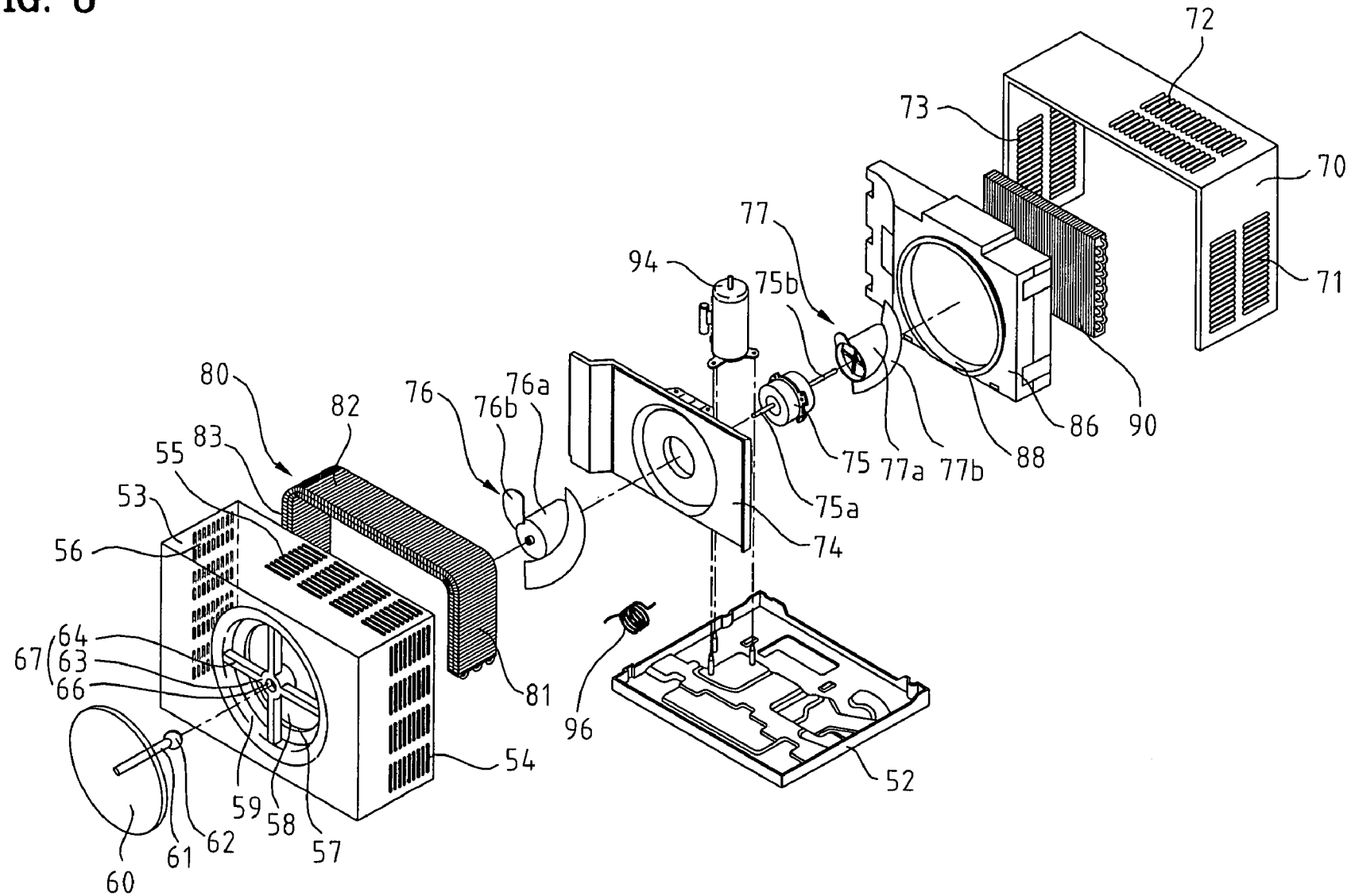
FIG. 8 illustrates an exploded perspective view of the air conditioner in FIG. 7.
Figure 9:
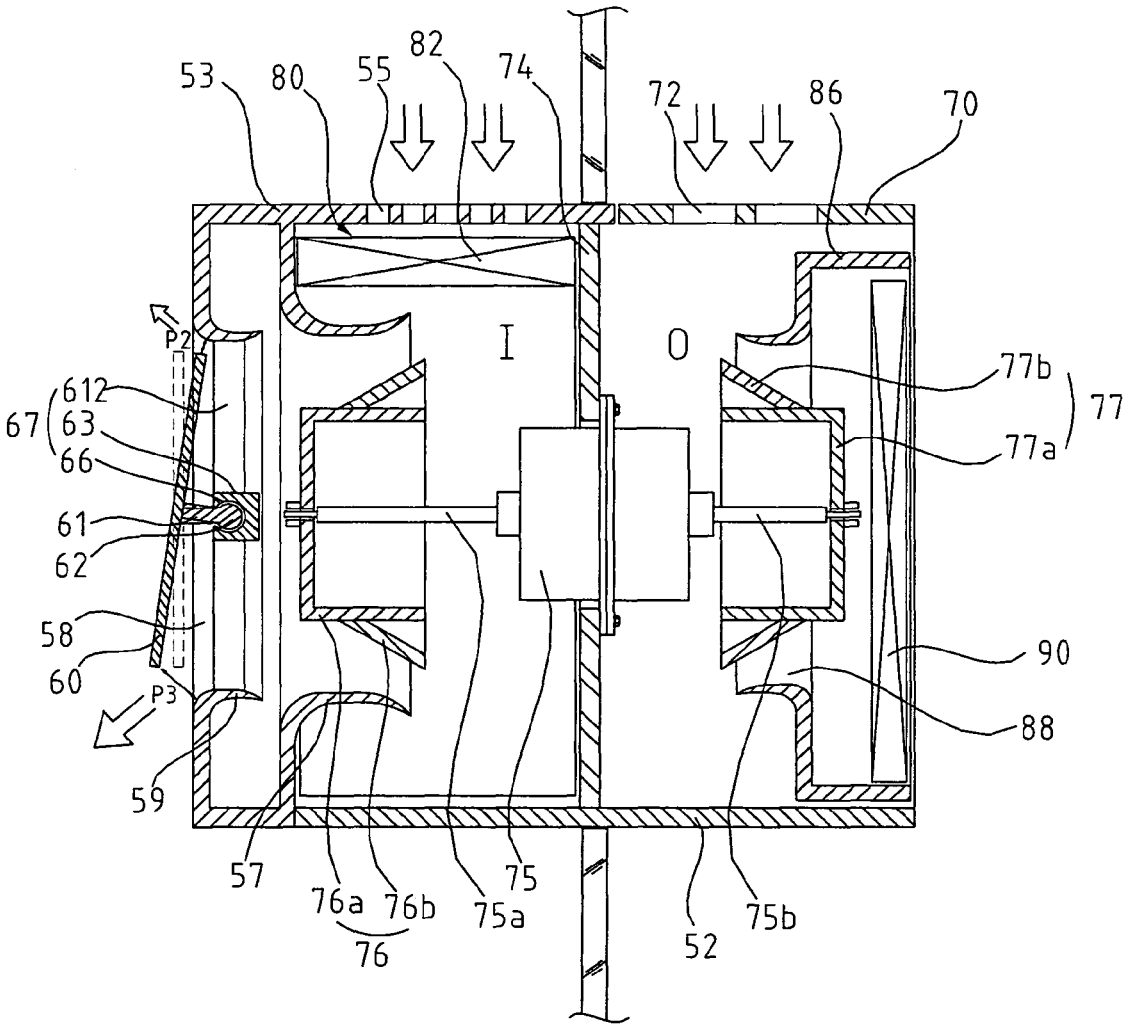
FIG. 9 illustrates a longitudinal section of the air conditioner in FIG. 7.

FIG. 7 illustrates a perspective view of an air conditioner in accordance with a second preferred embodiment of the present invention, FIG. 8 illustrates an exploded perspective view of the air conditioner in FIG. 7, and FIG. 9 illustrates a longitudinal section of the air conditioner in FIG. 7.

Referring to FIGS. 7 to 9, the air conditioner in accordance with a second preferred embodiment of the present invention will be described in detail.

The air conditioner in accordance with the second preferred embodiment of the present invention is identical to the air conditioner in accordance with the first preferred embodiment of the present invention substantially, except that the second embodiment air conditioner includes a panel supporter 61, 62, and 67 which can support the front panel.

In front of the front cabinet 53 of the second embodiment, there is a front panel 60 for adjusting a direction of discharged air. The front panel 60 has a plate slightly smaller an inside circumference of the air discharge guide 59 such that the front panel 60 can be tilted in all directions of up/down, and left/right sides from an inside of the air discharge guide 59.

The front panel 60 is constructed of a square plate if the air discharge guide 59 has a square section, and is constructed of a circular disc if the air discharge guide 59 is cylindrical.

In the meantime, the panel supporter includes a mounted bar 61 for mounting on the front panel 60, a ball 62 connected to the mounting bar 61, and a supporting member 67 having a ball socket 66 for holding the ball 62.

In more detail, the mounting bar 61 is fixedly secured to a center of a rear side of the front panel 60, and the ball 62 of a spherical shape is at an end of the mounting bar 61. The supporting member 67 is in the air discharge guide 59 for coupling the mounting bar 61 to the front cabinet 53.

The supporting member 67 includes a boss 63 with the ball socket 66 for placing the ball 62 therein, and a plurality of arms 64 between the boss 63 and the front cabinet 53. In more detail, the arms 64, between an outside circumference of the boss 64 and an inside circumference of the air discharge guide 59, connect the boss 64 to the front cabinet 53. The ball socket 66 has a spherical hole having one opened side, for placing in and rotating the ball 62.

It is preferable that the ball 62 and the ball socket 66 have a predetermined friction force when an external force is applied thereto, so that the front panel 60 can maintain a tilted state against a discharging air pressure.

Moreover, though the arms 64, supporting weight of the front panel 60, are required to have adequate thickness of ribs, it is preferable that the rib has a thickness and formed of material, that do not interfere with the discharging air flow.

Referring to FIG. 9, a process for changing a direction of discharging room air from the air conditioner of the embodiment will be described.

Upon applying external force to an upper side of the front panel 60, the ball 62 at the end of the mounting bar 61 rotates in the ball socket 66. At the same time with this, one side of the mounting bar 61 moves in a direction of the external force together with the front panel 60, such that the front panel 60 is tilted upwardly.

In this instance, there are a small gap P2 formed between the front panel 60 and an upper portion of the air discharge guide 59, and a large gap P3 between the front panel 60 and a lower portion of the air discharge guide 59.

Then, because the air introduced into the room air outlet 58 is discharged through the large gap P3 more than the small gap P2, the heat exchanged air can be concentrated on the lower side of the air conditioner.

Of course, upon applying external force to a left side of the front panel 60, the ball 62 at the end of the mounting bar 61 rotates in the ball socket 66, to tilt the front panel 60 to a left side. In this instance, a small gap is formed between the front panel 60 and a left side of the air discharge guide 59, and a large gap is formed between the front panel 60 and a right side of the air discharge guide 59.

Then, because the air introduced into the room air outlet 58 is discharged through the large gap on the right side more than the small gap on the left side, the heat exchanged air can be concentrated on the right side of the package type air conditioner.

However, the present invention is not limited to above embodiment, but all devices that can control tilting of the front panel can be used. For an example, HHHH.

Moreover, a plurality of front panels may be provided, for tilting the front panels in a plurality of directions to guide the discharging air in a plurality of directions. Of course, the front panel may also be provided to the inlet for controlling an amount of inflow air.

Figure 10:
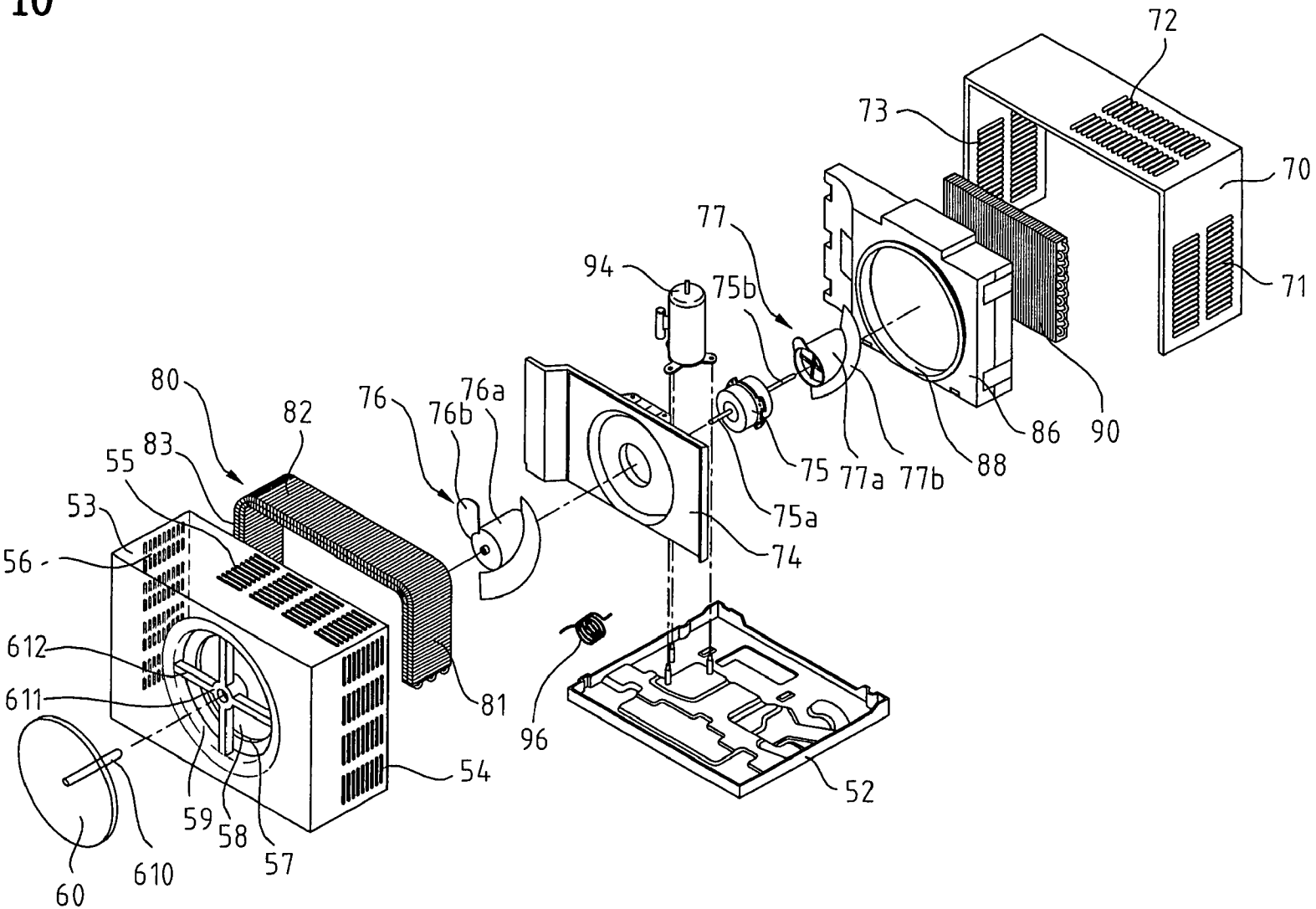
FIG. 10 illustrates a perspective view of an air conditioner in accordance with a third preferred embodiment of the present invention.
Figure 11:
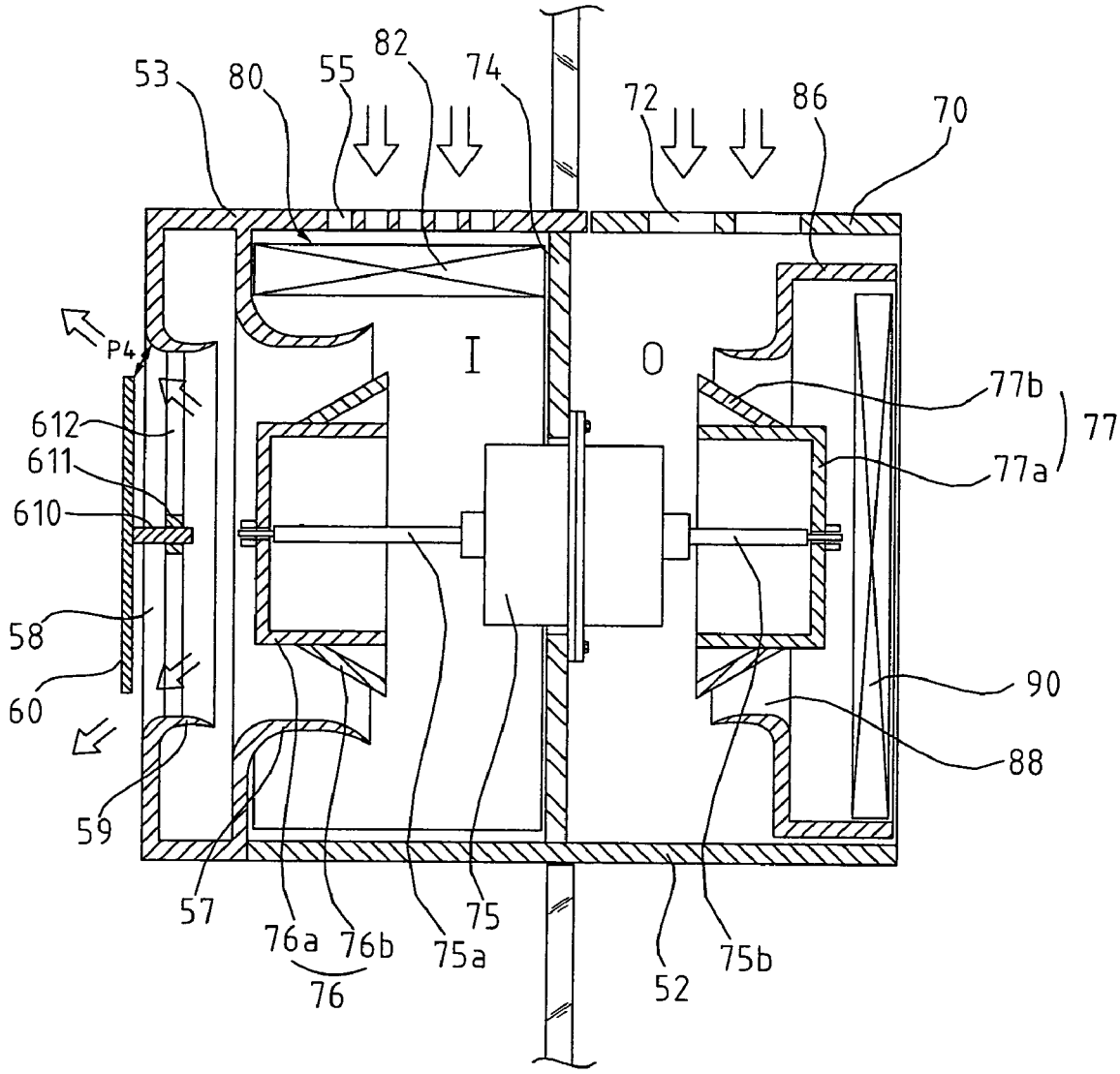
FIG. 11 illustrates a longitudinal section of the air conditioner in FIG. 10.

FIG. 10 illustrates a perspective view of an air conditioner in accordance with a third preferred embodiment of the present invention, and FIG. 11 illustrates a longitudinal section of the air conditioner in FIG. 10.

Though the third embodiment is identical to above embodiment basically, the third embodiment includes a panel supporter 610, 611, and 612 for supporting the front panel while the panel supporter is moved in a front/rear direction of the room air outlet 58. In more detail, the front panel 60 is mounted in front of the front cabinet 53 so to be movable in a front/rear direction of the room air outlet.

The panel supporter 610, 611, and 612 includes a mounting bar 610 fixedly secured to the front panel, a boss 611 through which the mounting bar 610 passes, and at least one arm 612 between the boss and the front panel.

In more detail, the mounting bar 610 is projected from the back surface of the front panel, and the boss 611 having the mounting bar 610 passing therethrough is position at a center of the air discharge guide 59. The arms 612 connect an outside circumference of the boss 611 and the inside circumference of the air discharge guide 59.

Therefore, if the front panel 60 is pulled forward, the mounting bar 610 moves forward of the room air outlet 58 as the mounting bar 610 is guided by the boss. Then, the front panel 60 is positioned in front of the air discharge guide 59, to form a gap P4 between the front panel 6 and the air discharge guide 59.

Once the front panel is moved forward of the air discharge guide 59, the air passed through the room air outlet 58 is discharged to front of the air conditioner through the gap P4 between the front panel and the discharge guide.

If the air discharge guide 59 has a square section, the front panel 60 has a shape of a square plate, and if the air discharge guide 59 is cylindrical, the front panel 60 has a shape of a circular disk. It is preferable that the front panel 60 has a size slightly smaller than an inside circumference of the air discharge guide 59, On the other hand, if the front panel 60 is pushed backward for changing a direction of room air discharged from the air conditioner, the mounting bar 610 moves backward guided by the boss 611. Then, the air blown forward by the room fan 76 passes through the gap between the front panel 60 and the air discharge guide 59, and discharged to front of the room air outlet.

Figure 12:
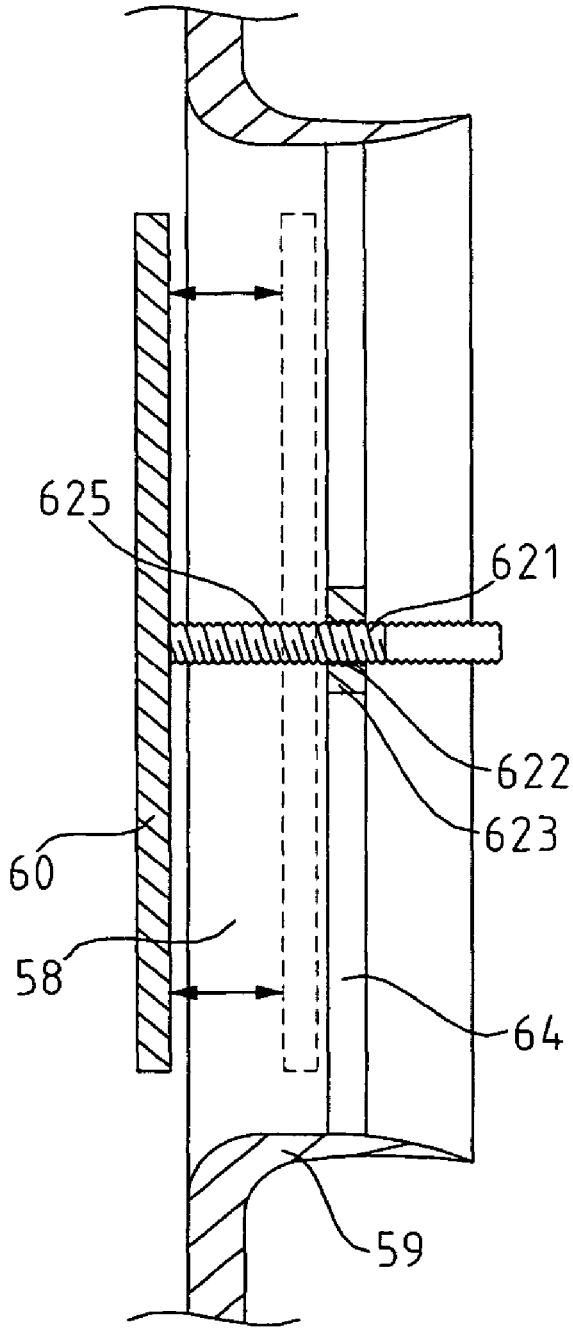
FIG. 12 illustrates a section of another embodiment of a panel supporter in an air conditioner of the present invention.

FIG. 12 illustrates a section of another embodiment of a panel supporter in an air conditioner of the present invention.

Different from above embodiments, in the embodiment, the mounting bar and the boss are joined with threads for moving the front panel. In more detail, the mounting bar 621 has a male thread 625 formed thereon, and the boss 623 has a female thread 622 formed thereon. Of course, the mounting bar 621 may have a female thread, and the boss 623 may have a male thread.

Accordingly, upon rotating the front panel 60 in one of clock, or anti-clock wise direction, the front panel 60 rotates, and moves forward with the mounting bar 621. Of course, is the front panel is rotated in a direction opposite to a case the front panel 60 is moved forward, the front panel 60 rotates in an opposite direction, and moves backward with the mounting bar.

Figure 13:
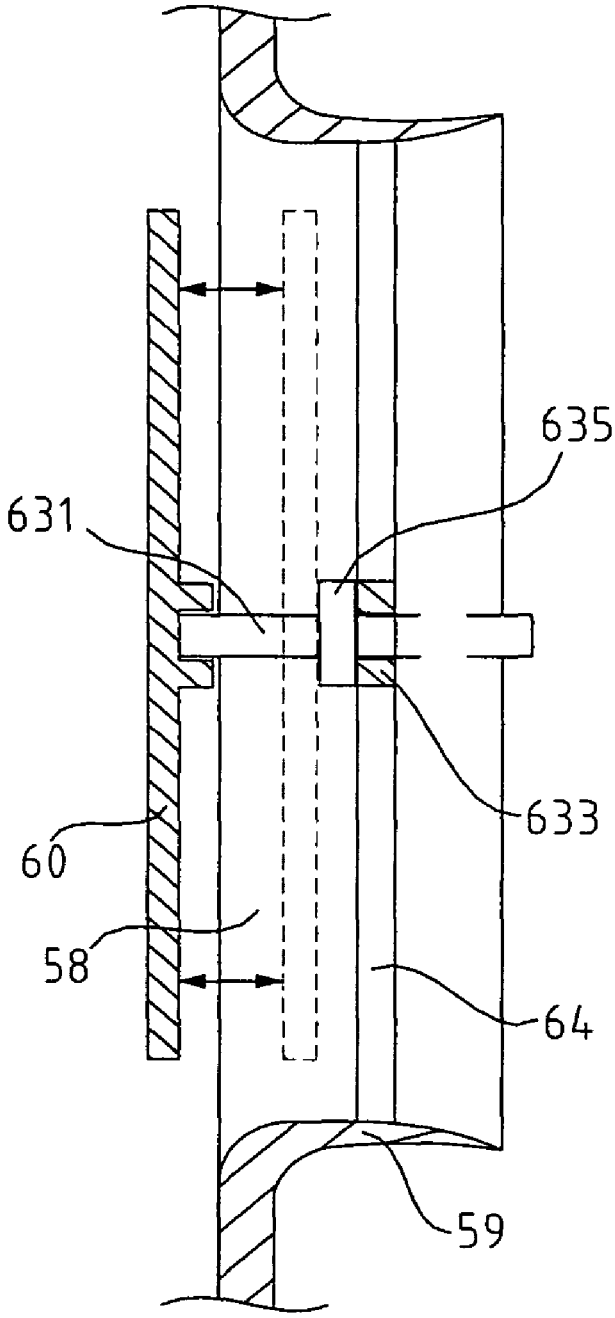
FIG. 13 illustrates a section of one embodiment of a panel mover in an air conditioner of the present invention.

FIG. 13 illustrates a section of one embodiment of a panel mover in an air conditioner of the present invention.

Different from above embodiments, the embodiment further includes a panel mover for moving the front panel.

The panel mover 631, and 635 includes a piston 631 mounted in rear of the front panel 60, and a motor 635 for driving the piston. In more detail, the piston 631 has a front end secured to a back surface of the front panel 60, and the piston 631 moves in a front/rear direction together with the front panel. The motor 635 is a linear motor for linear movement of the piston, and it is preferable that the piston 631 passes through the boss 633 and mounted in front of the boss 633.

Accordingly, if the piston 631 is moved to forward of the room air outlet by the motor 635, the front panel 60 moves forward together with the piston 631. if the piston 631 moves backward by the motor, the front panel 60 moves backward together with the piston 631, until the front panel 60 is positioned inside of the air discharge guide 59.

Figure 14:
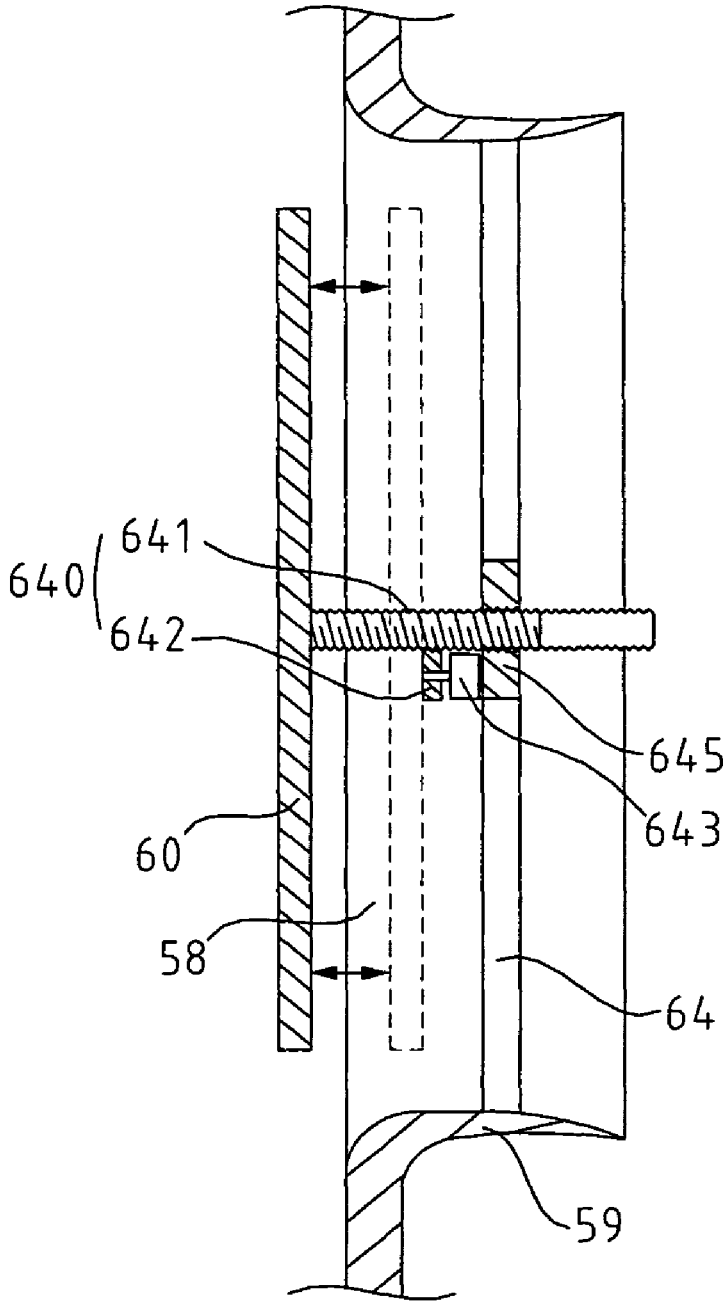
FIG. 14 illustrates a section of another embodiment of a panel mover in an air conditioner of the present invention.

FIG. 14 illustrates a section of another embodiment of a panel mover in an air conditioner of the present invention.

Different from above embodiments, the package type air conditioner of the embodiment further includes a panel mover with a power transmission device for moving the front panel.

The panel mover includes a motor 643 for providing power for driving the front panel 60, and a power transmission device 640 for transmission of power from the motor 643 to the front panel 60.

The motor 643 is reversible, and mounted on a boss 645 at one side of the cabinet. The power transmission device 640 includes a first gear 641 fixedly secured to a rotation shaft of the motor 643, and a second gear 642 engaged with the first gear. In more detail, the first gear 641 passes through, and is supported on the boss 645, and the second gear 642 has one side fixedly secured to a back surface of the front panel 60.

Therefore, if the rotation shaft of the motor 643 rotates, the first gear 641 rotates, and the second gear 642 rotates in a direction opposite to the first gear 641 in a state the second gear 642 is supported on the boss 645. As shafts of the first gear 641 and the second gear 642 rotate following rotation of the motor 643, the front panel 60 moves forward/backward.

However, the present invention is not limited to above embodiment, but the power transmission device 640 ma include a link, a lever, or a belt.

As has been described, the air conditioner of the present invention has the following advantages.

First, since no lovers are required, that require cleaning of foreign matters stuck thereto, the air conditioner can be used conveniently and production cost can be reduced.

Second, the front surface of the air conditioner only having the room air outlets permits to minimizes direct re-entry of discharged air.

Third, the discharge of heat exchanged room air to all directions of front of the air conditioner permits to shorten a time period required for cooling/heating the room.

Fourth, the free front/rear direction moving or tilting of the front panel with reference to the front cabinet permits to select a variety of air flow directions, and extend a range of air flow directions.

Fifth, the panel mover permits quick and convenient movement of the front panel, thereby permitting to adjust a direction of discharging air flow.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

a cabinet having room air inlets in at least one of side surfaces and a top surface, and a room air outlet in a front surface; and a front panel mounted on a front surface of the cabinet, the front panel located in front of the room air outlet, wherein the front panel is mounted spaced a predetermined distance from the room air outlet, and an air discharged from the room air outlet is discharged through a space between the front panel and the front surface of the cabinet such that the front panel blocks the air discharged from the room air outlet to detour the discharged air around the front panel.

2. The air conditioner as claimed in claim 1, wherein the front panel includes a panel mounting portion for mounting the front panel to the cabinet.

3. The air conditioner as claimed in claim 2, wherein the front panel is fixed with respect to the cabinet.

4. The air conditioner as claimed in claim 2, wherein the front panel moves parallel to the cabinet.

5. The air conditioner as claimed in claim 1, wherein the front panel is movably mounted.

6. The air conditioner as claimed in claim 5, wherein the front panel is tilted freely at least one direction with respect to the cabinet.

7. The air conditioner as claimed in claim 6, wherein the air conditioner further includes a panel supporter for supporting the front panel.

8. The air conditioner as claimed in claim 7, wherein the panel supporter includes:

a mounting bar fixedly secured to the front panel;

a ball connected to the mounting bar; and a ball socket for holding the ball.

9. The air conditioner as claimed in claim 8, wherein the panel supporter further includes a supporting member for connecting the ball socket to the cabinet.

10. The air conditioner as claimed in claim 9, wherein the ball socket has a spherical hole having one opened side, and is mounted at a center of the air outlet.

11. The air conditioner as claimed in claim 5, wherein the front panel moves in a front/rear direction of the room air outlet.

12. The air conditioner as claimed in claim 11, further comprising a panel supporter for supporting and guiding a moving direction of the front panel.

13. The air conditioner as claimed in claim 12, wherein the panel supporter includes:

a mounting bar fixedly secured to the front panel;

a boss having the mounting bar passed therethrough; and at least one arm between the boss and the front panel.

14. The air conditioner as claimed in claim 13, wherein the mounting bar moves in a front/rear direction of the room air outlet, together with the front panel.

15. The air conditioner as claimed in claim 13, wherein one of the mounting bar or the boss has a male thread formed thereon, and the other one has a female thread formed thereon.

16. The air conditioner as claimed in claim 11, further comprising a panel mover for moving the front panel.

17. The air conditioner as claimed in claim 16, wherein the panel mover includes:

a piston in rear of the front panel; and a motor for driving the piston.

18. The air conditioner as claimed in claim 16, wherein the panel mover includes:

a motor for driving the front panel; and a power transmission device for transmission of power from the motor to the front panel.

19. The air conditioner as claimed in claim 18, wherein the power transmission device includes:

a first gear fixedly secured to a rotation shaft of the motor; and a second gear engaged with the first gear.

* * * * *